US006842964B1

(12) United States Patent
Tucker et al.

(10) Patent No.: US 6,842,964 B1
(45) Date of Patent: Jan. 18, 2005

(54) PROCESS OF MANUFACTURING OF ELECTROSTATIC SPEAKERS

(75) Inventors: Timothy J. Tucker, Gainesville, FL (US); David A. Mann, Gainesville, FL (US); Willard W. Wilson, Gainesville, FL (US)

(73) Assignee: Tucker Davis Technologies, Inc., Alachua, FL (US)

( * ) Notice: Subject to any disclaimer, the term of this patent is extended or adjusted under 35 U.S.C. 154(b) by 512 days.

(21) Appl. No.: 09/675,430

(22) Filed: Sep. 29, 2000

(51) Int. Cl.[7] ..... H04R 31/00

(52) U.S. Cl. ..... 29/594; 29/592.1; 29/609.1; 381/113; 381/116; 381/174; 381/191

(58) Field of Search ..... 29/592.1, 594, 29/609.1; 381/116, 191, 113, 174

(56) References Cited

U.S. PATENT DOCUMENTS

| | | | | |
|---|---|---|---|---|
| 1,839,130 | A | * 12/1931 | Thomas | 381/191 |
| 3,612,778 | A | 10/1971 | Murphy | |
| 3,668,335 | A | 6/1972 | Beveridge | |
| 3,873,956 | A | 3/1975 | Kurtz et al. | |
| 3,935,634 | A | 2/1976 | Kurtz et al. | |
| 4,188,513 | A | * 2/1980 | Morrell et al. | 381/111 |
| 4,207,442 | A | 6/1980 | Freeman | |
| 4,247,796 | A | 1/1981 | Fiorentino et al. | |
| 4,262,399 | A | 4/1981 | Cady | |
| 4,281,222 | A | 7/1981 | Nakagawa et al. | |
| 4,321,432 | A | 3/1982 | Matsutani et al. | |
| 4,492,825 | A | 1/1985 | Brzezinski et al. | |
| 4,533,795 | A | 8/1985 | Baumhauer et al. | |
| 4,922,471 | A | 5/1990 | Kuehnel | |
| 4,996,627 | A | 2/1991 | Zias et al. | |
| 5,377,524 | A | 1/1995 | Wise et al. | |
| 5,629,578 | A | 5/1997 | Winzer et al. | |
| 5,642,015 | A | 6/1997 | Whitehead et al. | |
| 5,677,965 | A | 10/1997 | Moret et al. | |
| 5,682,290 | A | 10/1997 | Markow et al. | |
| 5,889,871 | A | 3/1999 | Downs, Jr. | |
| 6,178,249 | B1 | 1/2001 | Hietanen et al. | |
| 6,201,874 | B1 | * 3/2001 | Croft et al. | 381/191 |
| 2002/0076041 | A1 | 6/2002 | Hietanen | |

FOREIGN PATENT DOCUMENTS

CA 1107382 A1 8/1981

OTHER PUBLICATIONS

Hietanen, Jarmo et al., "An Integrated Printed Circuit Board (PCB) Microphone," J. Acoust. Soc. Am., May 2000, L25–L30 pp, 107(5), Pt 1. Acoustics Research Letters Online. Acoustical Society of America.

Schuller, G., (1997) "A Cheap Earphone for Small Animals with Good Frequency Response in the Ultrasonic Frequency Range" J. Neuro. Meth. 71: 187–190.

* cited by examiner

*Primary Examiner*—A. Dexter Tugbang
*Assistant Examiner*—Paul D Kim
(74) *Attorney, Agent, or Firm*—Joseph Fischer, Esq.; Beusse, Brownlee, Wolter, Mora & Maire, P.A.

(57) ABSTRACT

An electrostatic speaker is constructed using a thin flexible membrane as the active member. This membrane is uniformly positioned against at least one printed circuit board containing at least one stator fixed in the PCB. Variations in structure are provided, all including at least one PCB and a membrane. In a preferred embodiment, intermeshing opposing ridges on the PCBs are adjacent to a central vibrating area of the membrane, and serve to position and tension the membrane. Attachment means connect the PCBs together, and electrical connections permit the passage of current to bias the membrane and to drive the stators to vibrate the membrane, producing acoustical output in the sonic or ultrasonic ranges. The invention also relates to the electrostatic speakers produced by this method of manufacture.

19 Claims, 9 Drawing Sheets

PROCESS OF MANUFACTURING OF ELECTROSTATIC SPEAKERS

Statement of Invention Rights under Federally Sponsored Research: This invention was made with government support under grant DC04014 awarded by the National Institutes of Health. The government has certain rights in the invention.

FIELD OF THE INVENTION

This invention relates to electrostatic speakers formed on or in a printed circuit board, and the processes of manufacture and use thereof.

BACKGROUND OF THE INVENTION

The art of producing speakers has evolved over the past decades, often involving a variety of novel transducer arrangements. Traditional speakers use a coil to induce a magnetic force based on electrical signals derived from acoustical signals. A series of such magnetic forces attract and repel the coil, and an attached cone, to and from a permanent magnet, thereby vibrating the cone to create a sound.

In contrast, electrostatic speakers, which is synonymous with electrostatic loudspeakers (ESLs), utilize a thin diaphragm, or membrane, to produce a sound. This membrane is placed under tension. Typically this membrane has a coating, such as aluminum or graphite, on one side that will hold an electrostatic charge when supplied with a high voltage. One or more stators are spaced adjacent to the faces of the membrane. A stator is an electrically conductive stationary plate that, when charged, attracts or repels the charged membrane, thereby causing the membrane to move to produce sound. Insulating spacers separate the one or more stators from the membrane. These spacers must maintain a critical distance, close enough for the stators to exert a sufficient force to move the membrane, and far enough to prevent the membrane surface's high voltage from discharging onto the stator or another nearby component either through contact or jumping of charge. An amplified electrical signal drives each stator, which variably and alternately attract or repel the charged membrane, causing the membrane to move, respectively, toward or away from the respective stator. Typically, one stator is placed to each side of the membrane, so the force applied over the distance the membrane moves stays relatively constant, thereby avoiding distortion of the resulting sound over a range of frequencies. Two sources of information about electrostatic speakers, which are incorporated herein by reference, are:

1. Electrostatic Loudspeaker Design and Construction, $2^{nd}$ Edition, Ronald Wagner, Audio Amateur Publishers, Peterborough, N.H. (1993, ISBN 0-9624-191-6-8).
2. The Electrostatic Loudspeaker Design Cookbook, $1^{st}$ Edition, Roger R. Sanders, Audio Amateur Publishers, Peterborough, N.H. (1995, ISBN 1-882580-00-1).

Specially designed speakers have been described in the commercial and patent literature. For instance, a commercially available electrostatic speaker, made by MartinLogan, utilizes a diaphragm, spacers on each side, and curved stators peripherally, where the stators have numerous small holes. The speakers produce audible sound reported to have exceptional linearity and low distortion. These speakers can be several feet high, demonstrating suitable spacer placement over a large speaker area. Descriptions of other related devices can be found in U.S. Pat. Nos. 5,239,589, 5,682,290 and 5,889,871.

The present invention represents an improvement in the art of production of ESLs by incorporating at least one printed circuit board (PCB) into an ESL, and by using a combination of features in conjunction with the PCB to manufacture ESLs with reproducible tolerances, leading to improved precision and performance. The invention also is well suited for mass-production and scale-up techniques.

SUMMARY OF THE INVENTION

Reliable sound production from an ESL requires proper membrane tensioning and precise spacing of the membrane in relation to the stator(s). The present invention provides an improved speaker design and method of manufacture that advances the art for ESLs. The design and method of manufacture employ specific structures, at least one PCB in combination with another PCB, an opposing membrane holding means, spacing and membrane holding structures, or combinations of these structures.

In one embodiment of this invention, a membrane-tensioning feature is integrated into or is in combination with at least one PCB having at least one stator. These features effectively position and tension the membrane, thereby solving the problems of proper membrane tensioning, and precise distancing of the membrane in relation to the stator(s). The membrane tensioning system disclosed herein facilitates mass production of speakers made according to this invention. Speakers produced by this method show good consistency in performance, as measured by response curves.

The advantages of this invention provide an easy, reliable method of manufacture for an ESL having stators on PCBs that sandwich a membrane, and provide a finished ESL made of one or more PCBs and a membrane tensioned by or adjacent to the PCB structure. PCBs can be manufactured in a wide array of shapes and sizes. The PCB integrates the electrical circuitry, the stator(s), provides the positioning between the stator(s) and a chargeable membrane, and can hold the membrane in place.

The ESL device of this invention contains one or two PCBs that distance, and optionally tension, a membrane spaced from one or more stators on one or both structures that surround the membrane. In speaker operation, a biasing electrical charge passes to a chargeable side of the membrane and imparts a charge to that side. An alternating electronic signal passes through conducting channels on the PCBs to drive the stators, which, due to electrical charge attraction and repulsion, causes the membrane to oscillate, producing sound.

Additional objects, advantages, and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

FIG. 1A depicts an embodiment comprising one stator disposed on a printed circuit board (PCB), a membrane, and an opposing membrane holding means (OMHM) comprising a surrounding membrane holding means the (SMHM) that surrounds a central speaker area. FIG. 1B depicts an embodiment similar to that in FIG. 1A except the OMHM comprises a stator and is not open in the central speaker area. FIG. 1C depicts an embodiment in which each of two printed circuit boards that sandwich a membrane is adjacent to and disposed outwardly to a separate OMHM. FIG. 1D depicts an embodiment comprising two printed circuit boards that sandwich a membrane, one outward and adjacent to an OMHM, the other comprising an OMHM. FIG. 1E depicts an embodiment of an electrostatic speaker comprising a PCB outward and adjacent to an OMHM, a membrane, and a SMHM comprising an open interior and an OMHM. FIG. 1F depicts an embodiment similar to FIG. 1E except that the SMHM does not comprise an OMHM; rather an OMHM is disposed between the SMHM and the membrane.

DETAILED DESCRIPTION OF THE INVENTION

Figure 1:
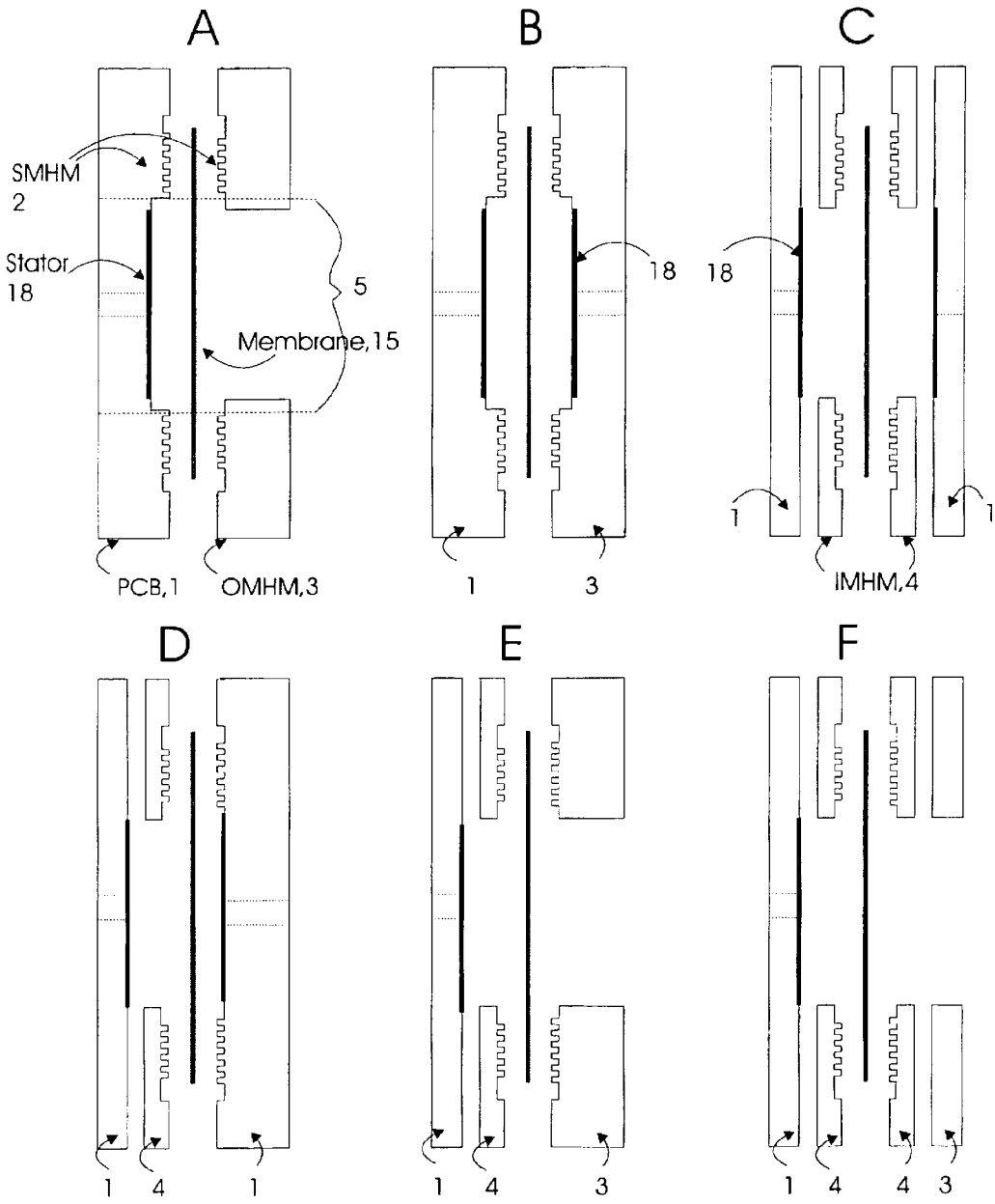
FIG. 1A–F provides six cross-sectional exploded side view representations of possible speaker structures that can sandwich the membrane according to this invention.

According to the present invention, the foregoing and other objects and advantages are attained by manufacturing an ESL having a variety of possible configurations of structures that position and tension a membrane a set distance from at least one PCB. FIG. 1 provides schematic diagrams that exemplify alternatives of the process and product according to this invention. Particularly, during manufacture of an ESL according to the invention a membrane is interposed and affixed between:

1. one PCB having one or more stators and one opposing membrane holding means (OMHM), which may be an open-centered structure, such as a ring, in a basic embodiment, both the PCB and the OHMB having a surrounding membrane holding means (SMHM) that positions and tensions the membrane (FIG. 1A);
2. one PCB on each side with one or both having at least one stator, both PCBs having a surrounding membrane holding means that positions and tensions the membrane (one possible embodiment of FIG. 1B); or,
3. one PCB with at least one stator, and an intermediate membrane holding means (IMHM), such as an open-centered structure, such as a ring, on one side, where the IMHM contacts, positions, and tensions the membrane and on its opposite side contacts the PCB, opposed either by a second set of PCB and intermediate membrane holding means (FIG. 1C), by a PCB by itself (FIG. 1D), or by an OMHM by itself (FIG. 1E) or in combination with an intermediate membrane holding means (FIG. 1F).

The basic structural relationships and operation of the three variations listed above are now described. Referring to FIG. 1A, which is a cross-sectional exploded view of one ESL, a central speaker area, 5, is positioned generally centrally in the PCB section, 1. In alignment with the central speaker area the PCB contains at least one stator, 18, preferably in the second layer from the membrane side, but alternatively in any layer of the PCB. In the first variation described above, as shown in FIG. 1A, the PCB has an SMHM, 2, that surrounds the central speaker area. This structure contacts the membrane, 15, and serves to position and tension the membrane. The positioning and tensioning, depending on the embodiment of the process, may occur partly when only one PCB, or one PCB and an IMHM, is in contact with the membrane. This may be accomplished, for example, by applying adhesive and physically stretching the membrane across the SMHM. Normally the positioning and tensioning is not complete until the second side's structure, comprising any of the variations listed above, is affixed, thus forming an ESL. As will be described herein, an additional step, heating the ESL, serves to further tighten the membrane after the noted affixing.

In the first variation, as depicted in FIG. 1A, the OMHM, 3, also has an SMHM that, when positioned against the SMHM of the first PCB, acts to position and tension the membrane. In a simple embodiment, the OMHM consists of a perimeter structure, similar to a flat washer, having a shape that overlays the opposing structure's SMHM, and having a void in the area between, across the central speaker area. Affixing the OMHM to the first PCB may occur by mechanical pressing, punching, gluing, welding, or other means known in the art. In other embodiments, within or beyond the SMHM, the OMHM has holes or other means for affixing, such as by screws, nuts and bolts, etc. Regarding the OMHM that opposes the PCB section, 1, it is noted that the area across the central speaker area may be filled in with structural material and components, which may include at least one stator, electrical connections, and at least one aperture for the passage of acoustical signals. Thus the term OMHM as used in this invention may mean, in addition to the open-centered structures shown in FIG. 1, structures having filled interior sections similar to the PCB that is opposed. Although the OMHM typically designates a solid structure not fabricated as a PCB, in fact, in its broadest meaning, the OMHM can be a second PCB that opposes the first PCB, having the membrane interposed and affixed between. Thus, the OMHM, 3, in FIG. 1B represents either a second PCB, or a non-PCB structure having its central speaker area filled in, including with a stator.

In the third variation, depictions of which are FIGS. 1C, 1D, 1E, and 1F, at least one IMHM, 4, has an SMHM that functions as described above. In this embodiment, the SMHM on the IMHM contacts the membrane, and the IMHM contacts either an OMHM or a PCB. This multi-component arrangement may be on both sides of the membrane. These components are affixed together during assembly.

The OMHM in any of the variations above may additionally comprise electrical circuitry means to transmit an electronic biasing current to the chargeable side of the membrane. However, if the chargeable side of the membrane faces the first PCB, then the first PCB comprises this electrical circuitry means. Also, the first PCB, and any other structure that comprises at least one stator, additionally comprises electrical circuitry means to transmit an electrical signal to each of the at least one stator.

In accordance with another aspect of the invention, in addition to the above listed variations, an ESL made according to this invention also may be produced by the attachment of a membrane to a single PCB having an SMHM, upon which the membrane is securely fastened, as by adhesive. The PCB in this embodiment has, at a minimum, at least one stator, electrical circuitry connecting to the at least one stator, and an SMHM. An electrical circuit to connect to the membrane for charging is prepared on the PCB or implemented from the non-PCB side of the membrane. A critical aspect of this embodiment is to have an effective design of the SMHM and effective attachment of the membrane to it, such as by adhesive, since there is no support or compression from the non-PCB side.

In accordance with the invention, the membrane vibrates in the central speaker area during operation of the ESL. Preferably, sufficient space around the membrane in the central speaker area exists to avoid the membrane contacting an adjacent structure or coming so close to a structure that the biasing charge is discharged to that structure. In simple embodiments, particularly in small ESLs and in ESLs that transmit high frequencies (which move less distance), sufficient space derives from preparing the SMHM of the PCBs to have a taller profile. This would provide space between the membrane and any solid structure in the central speaker area. The same approach would apply to an OMHM that has material across the central speaker area.

Other means to provide sufficient space for the membrane to vibrate include (i) preparing printed circuit boards, and if such are being used, preparing the OMHM so sufficient space exists in each part's central speaker area; (ii) providing an additional means for spacing between the membrane and the at least one printed circuit board and, if such are being used, the OMHM (when this has material close to the membrane in the central speaker area); or providing the sufficient space by a combination selected from (i) and (ii). For instance, a PCB may be manufactured having a blind or buried hole in the central speaker area, or after PCB manufacture an area in the central speaker area is milled out to form a space. An OMHM that does not have material in the central speaker area provides space through its design and fabrication. Alternately, either a PCB or an OMHM can be supplemented with an IMHM that serves a spacer function.

In each variation there is sufficient space on both sides of the membrane for the membrane to vibrate without contacting another element in the central speaker area, and in each variation one element on each side of the membrane possesses a structure that serves to tighten the membrane. The preferred method for positioning and tightening the membrane employs the use of opposing sets of parallel ridges, where at least one ridge on one structure presses the membrane between two parallel ridges on the structure opposing it on the opposite side of the membrane. This intermeshing of opposing ridges serves to hold and tighten the membrane.

In addition, in each variation electrical circuits are provided to conduct electrical charges from external sources, such as amplifiers, to the membrane and to at least one stator so the speakers are properly powered and function. Optionally, for each electrical circuit an electrical connection may be provided to facilitate connection to one of the external sources.

Regarding the SMHM, there are alternative structures for positioning and tensioning in addition to the preferred parallel intermeshing ridges. These include opposing flat bands of material that have a roughened surface, where each surface has a high friction coefficient. In one embodiment, a membrane is placed under tension between these opposing flat bands (one on each of the first PCB and the OMHM, or other variations as described above) and pressure is maintained during affixing, the high friction against the membrane contributing to setting the final membrane position and tension Another alternative is flat opposing bands that are designed to enhance effectiveness of adhesive. In this variation adhesive is applied on at least one SMHM during assembly, a tensioned membrane is placed onto one SMHM having the adhesive (the SMHM being on a PCB, an OMHM, or an IMHM). The adhesive serves to position the membrane. Based on the present teachings, those skilled in the art will know other specific designs and configurations that may be used to provide an acceptable result, which are variations that can be made without departing from the spirit of this invention.

Regarding the embodiments using a roughened or adhesive-facilitating surface, additional affixing can include attachment by screws, nuts and bolts, rivets, spot welding, ultrasonic welding, or other means of attachment known to those in the field. These means, which is not meant to be a limiting list, also can be used for affixing when concentric ridges are on the SMHM.

In accordance with another aspect of the invention, an ESL method of manufacture has the following steps: placing a membrane on or over a first printed circuit board; and placing an OMHM, which can be a retaining ring, a second printed circuit board, or another structure capable of holding the membrane, over this to sandwich the membrane. Separate electrical circuits are provided to transmit electrical biasing current to the membrane, and to transmit electrical signals to the at least one stator.

In the preferred methods, two PCBs, one for each side of the membrane, are prepared to have at least one parallel spaced ridge that defines a perimeter area. The parallel spaced ridges of the PCBs intermesh, serving to tension the membrane during assembly and subsequent use. This provides for a stable membrane uniformly placed between the stators in the PCBs. An optional initial step is to apply an adhesive to one PCB surface to better adhere and stretch the membrane during assembly. An optional step after the membrane is assembled into the PCBs is to heat the device to provide additional tensioning. This heating shrinks the membrane in its final position.

When the membrane used in the manufacture extends beyond the area where the membrane is positioned and tensioned, an additional step is to remove that excess membrane away, as by cutting, heating means, pressure means, or a combination of these. One example of removing the excess membrane is by use of heated metal blades that press against the membrane. This can occur after initial placement of the membrane on the first printed circuit board, or may occur at a later stage of assembly, such as after the OMHM has been affixed. In the latter instance, preferably protective insulation or covering would be added to the exterior edges of the ESL to prevent contact to the membrane, which during operation has a biasing charge.

Uniform spacing between the membrane and stators is provided by the accurate lamination of the PCBs, including, in the preferred embodiment, the precise manufacture of the parallel spaced ridges of the SMHM. It is noted that by parallel spaced ridges, it is meant that the ridges are generally parallel. The spacing allows opposing ridges to intermesh to position and tighten the membrane positioned in between. When the parallel spaced ridges are designed in the form of a triangle, rectangle or other multi-sided polygon around the central speaker area, the ridges need not be strictly parallel at the junctures of the sides.

It is noted that the Figures depicting this invention are merely representative of particular embodiments and are not meant to limit the range of possible configurations. The features are represented and described by numbers consistent from drawing to drawing, where possible.

Figure 2:
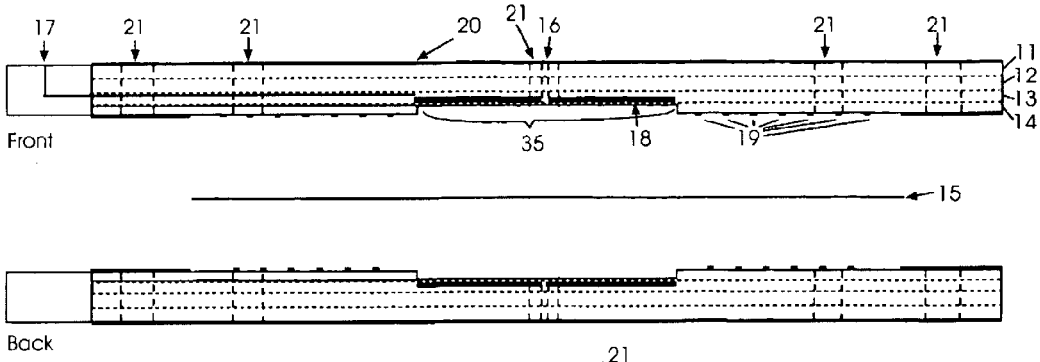
FIG. 2 is a cross sectional exploded view of one embodiment of an ESL device according to this invention, showing a front section PCB and a back section PCB.

Moving to examples of PCB structure and assembly of an ESL in accordance with other aspects of the invention, the invention, FIG. 2 is a cross sectional cut-away drawing of one embodiment of an assembled ESL device according to this invention. The front section PCB and the back section PCB are indicated in this drawing. FIG. 2 shows, for each PCB section, an outermost layer, 11, an intermediate insulating layer 12, made of insulating material such as fiberglass or plastic, a second innermost layer 13 (preferably containing the stator), the innermost layer 14, and the membrane, 15. Apertures, 16, pass through these layers, facilitating the transmission of acoustical output beyond the ESL. A retaining shield, 20, made of radiation-blocking material such as a metal, covers each outermost layer, 11, and serves to block the release of electrical noise from the ESL. On the inside face of the inside layer of each PCB section, ridges, 19, are present. Normally, one more ridge is present on one PCB section than on the opposing PCB section, to facilitate efficient intermeshing. Holes, 21, shown in cross-section, are for affixing the front and back section with the membrane positioned between. The stator, 18, is in the preferred second layer from the innermost layer, having an electric circuit, 17, connected to it. It is noted that stators can be positioned in any layer of a PCB. The innermost layer, 14, is shown having a void, 35, in the area between the stator, 18, and the membrane, 15.

Figure 3:
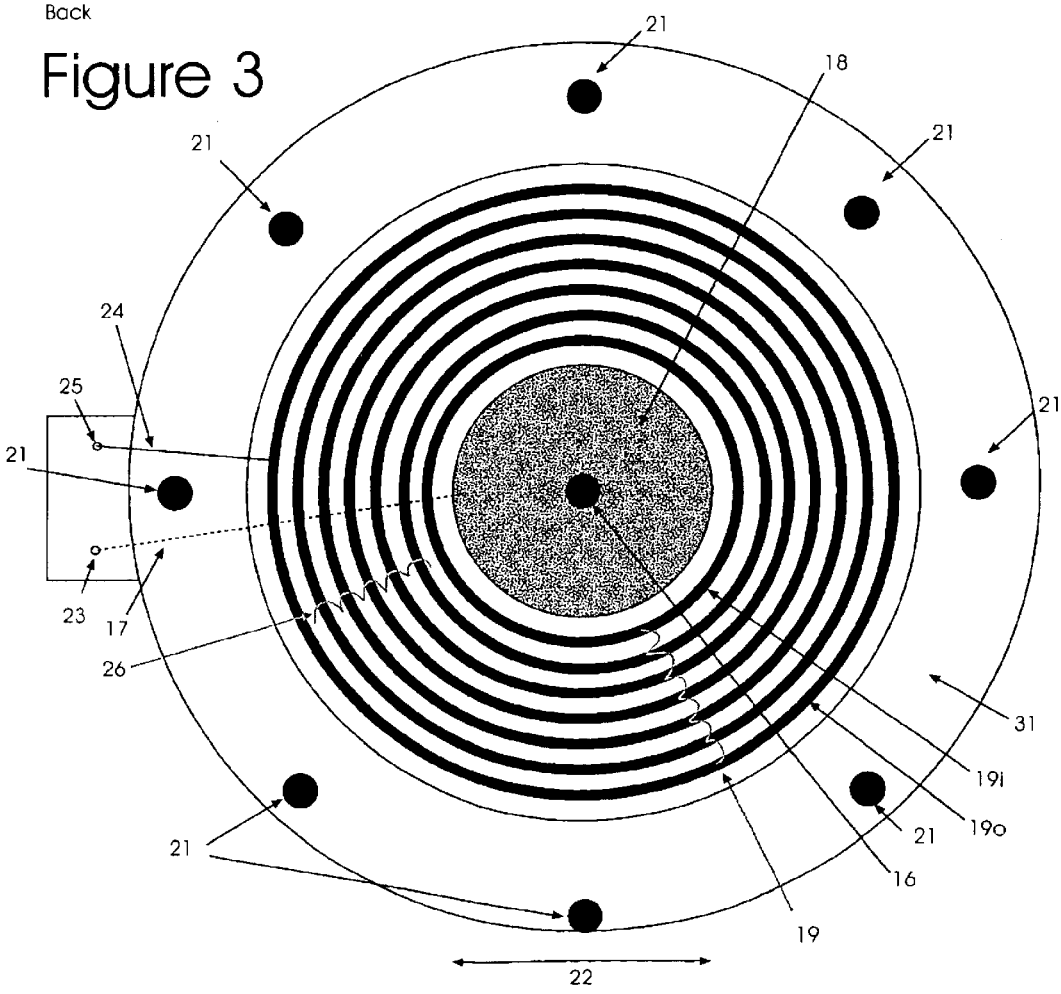
FIG. 3 is a top-down view of the inner layer of one PCB of an ESL of the invention.

FIG. 3 shows many of the elements in FIG. 1 in a top-down view of the innermost layer of the front PCB section. The stator, 18, is shown centered in the central speaker area, 5, the latter having a diameter, 22, and comprising the area, including components, within the innermost ridge, 19i. One electric circuit, 17, passes from an electrical connection, 23, along a path on the second innermost layer, 13, to the stator, 18. A second electric circuit, 24, leads from a second electrical connection, 25, along a path on the innermost layer, 14, to the outermost ridge, 19o, of the set of ridges, 19. The ridges, 19, form continuous, concentric, parallel structures surrounding the central speaker area. Grooves, or valleys, 26, lie between and to the side of the ridges, providing space for the intermeshing of ridges from the front and back section. Peripheral to the ridges is a peripheral plate, 31, an optional feature that braces the compressive forces of screws, nut and bolts, and other affixing means. Eight holes, 21, penetrate the retaining band, 31, and are used for affixing.

Figure 4:
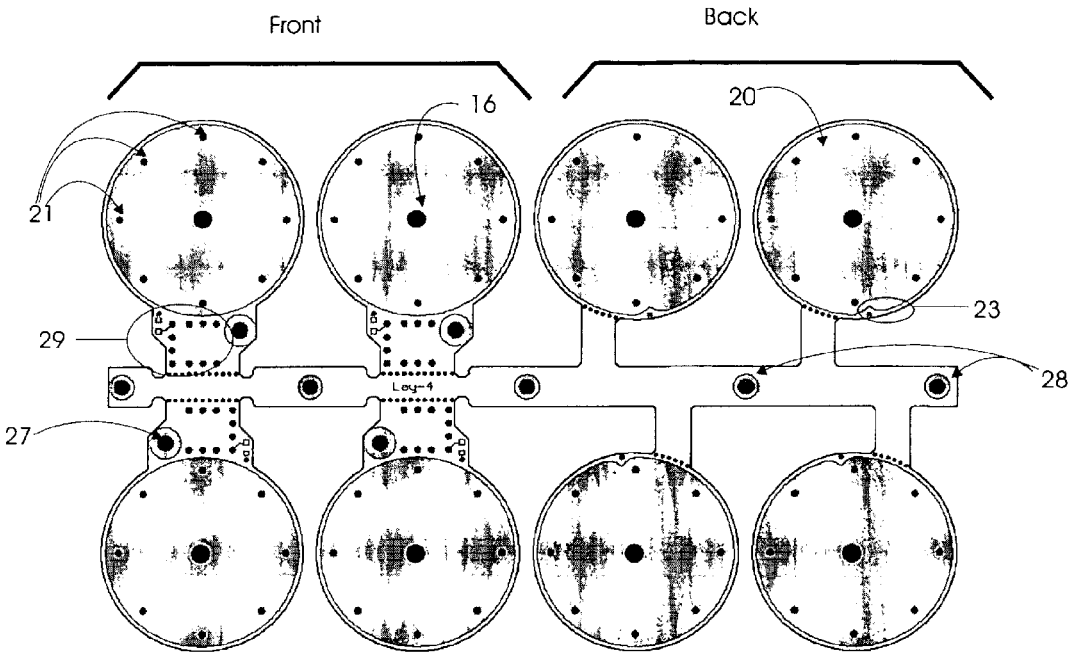
FIG. 4 is a view of the outer layer of a PCB plate that contains four front speaker areas and four rear speaker areas.

In accordance with another aspect of the invention, FIG. 4 is a drawing of the outermost layer, 11, of a PCB panel used for the ESL device. The four speaker areas to the left represent the 'front' speaker side, facing the listener, and the four speaker areas to the right represent the 'back' speaker side, which will face away from the listener in the typical mounting configuration. The drawing shows an aperture for acoustical transmission, 16, trans-layer leads for electrical transmission, 29, holes for assembly, 21, and holes for mounting, 27. Holes for alignment during assembly, 28, are on the PCB plate external to the speaker areas. Retaining shield 20 is a flat ring or plate. As a plate this feature covers most of the exterior surface. The retaining shield has been observed to decrease electronic noise beyond the ESL, presumably by absorbing electromagnetic energy. A retaining shield is utilized in the preferred embodiments. Trans-layer conductive leads shown in this figure are described in detail in a later figure.

During assembly, the front section speaker areas of one PCB plate, as shown in FIG.4, would be opposed by the back section speaker areas of a second PCB plate identical to the one shown in FIG. 4. Thus, two PCB plates as shown would produce eight ESLs. This assembly embodiment is described further in reference to FIG. 10.

Figure 5:
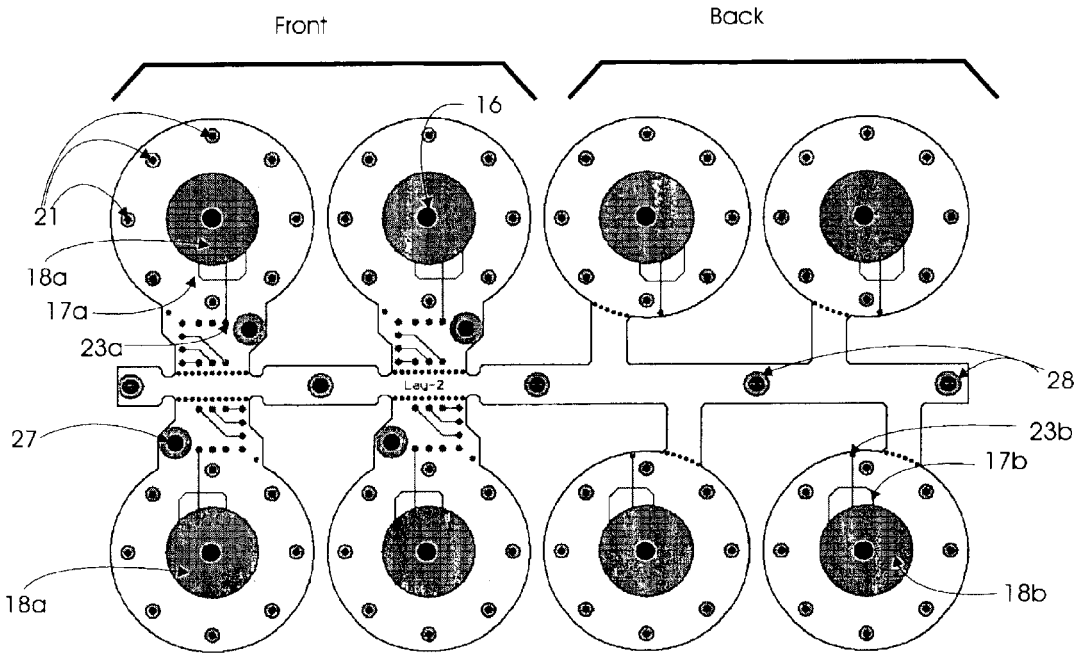
FIG. 5 is a view of the second innermost layer of a PCB plate that contains four front speaker areas and four rear speaker areas.

FIG. 5 depicts the inner stator layer, 13, of the same PCB panel. This layer contains, for each speaker area, a centrally positioned stator 18. Each front speaker side has an electrical connection 23, connected to an electrical circuit, 17*a*, for the front stator, 18a. Each back speaker side has an electrical connection 23*b*, connected to an electrical circuit, 17*b*, for the back stator, 18*b*. Also shown are surrounding holes for assembly, 21, holes for mounting the assembled ESL, 27, and holes for alignment during assembly, 28. As shown in FIG. 2, this layer and the layer depicted in FIG. 4 are separated by a non-conductive insulating layer, 12, such as of fiberglass or plastic.

Figure 6:
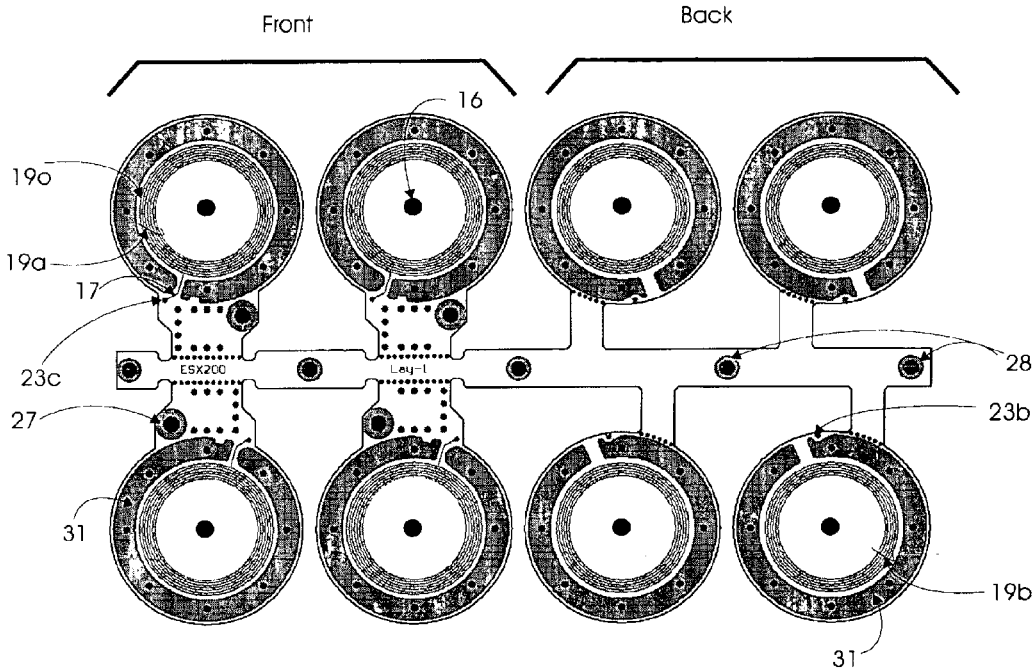
FIG. 6 is a view of the innermost layer of a PCB plate that contains four front speaker areas and four rear speaker areas.

In accordance with another aspect of the invention, FIG. 6 depicts the innermost layer, 14, of the same PCB panel. In the center of each speaker area is the void, 35. Observable in the center of each void is the aperture, 16, which passes through the stator, 18, in the second innermost layer, 13 (see FIG. 2), and through the two outermost layers, 12 and 11. Each central speaker area is surrounded by a series of parallel spaced ridges, 19*a* and 19*b*, and a broad retaining band, 31. For the front side of each speaker area, one electrical circuit, 17, connects from the electrical connector, 23*c*, to the outermost parallel spaced ridge, 19*o*. This passes the current to the parallel spaced ridges that conduct the biasing charge to the metallized side of the membrane, 15 (see FIG. 2). There also are holes for alignment during assembly, 28.

Figure 7:
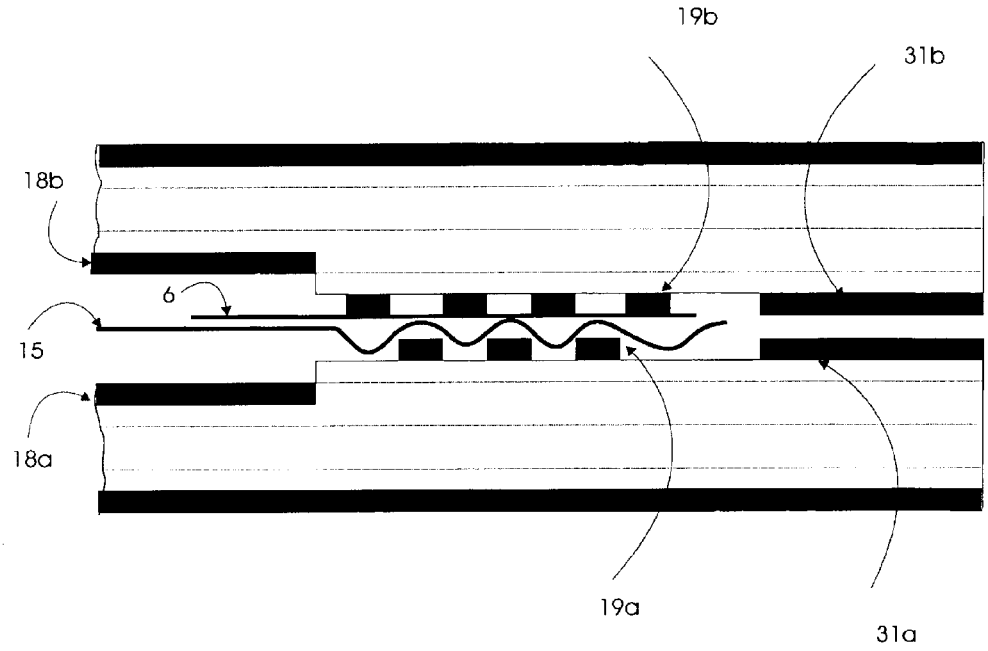
FIG. 7 is a cross section schematic view of the interaction of the ridges, the membrane, and the retaining band one embodiment of the invention.

In accordance with another aspect of the invention, FIG. 7 is a detailed drawing showing the membrane 15 pressed between parallel spaced ridges 19*a* and 19*b*, from opposing PCB panels. Distal to these ridges is the peripheral plate, 31, which is an optional feature that can function to set allowable compression in the area external to the SMHM. The peripheral plate can be provided to only one side of the membrane, 15, or to both sides as shown in FIG. 7, designated as 31*a* and 31*b*. The peripheral plate or plates prevent a PCB panel or an OMHM from deforming when a membrane is utilized that is thin relative to the space that exists laterally in the area external to the SMHM, when the affixing means is in this area. For example, the peripheral plate acts as a spacer, such that peripheral plate 31*a* on the front PCB panel presses against an opposing peripheral plate 31*b* on the back panel. These cross-sectional layers support the compression resulting from affixing the parts together, such as by screws, nuts and bolts, etc., and prevent deviations or stresses that could reduce the integrity of the ESL. The thickness of these peripheral plates is adjusted for the membrane thickness in various embodiments.

In relation to the peripheral plates and the membrane, it is noted that when the membrane is cut close to the SMHM, the membrane does not extend into the surrounding area described in the above paragraph. In this case, the thickness of the peripheral plates would be determined assuming no membrane thickness contribution. Also, it is noted that when the PCB and the OMHM have sufficient rigidity relative to the compression imposed by affixing these structures together, the peripheral plates are not needed and may be omitted.

Also referring to FIG. 7, it is noted that the term "intermesh" as used in the present invention is defined to include all of the following:

1. When ridges, 19*a*, of one PCB panel approach but do not cross the plane, 6, this plane being defined by the front faces of the opposing PCB's ridges, 19*b*.
2. When the front faces of the ridges, 19*a*, of one PCB panel align with the plane, 6.
3. When ridges, 19*a*, of one PCB panel cross the plane, 6.

The term "front faces" refers to the ridge surfaces most distal from the body of the respective PCB. When the ridges are designed to deeply intermesh (number 3 above), the peripheral plates, 31*a* and 31*b*, are less thick to permit this level of intermeshing.

Figure 8:
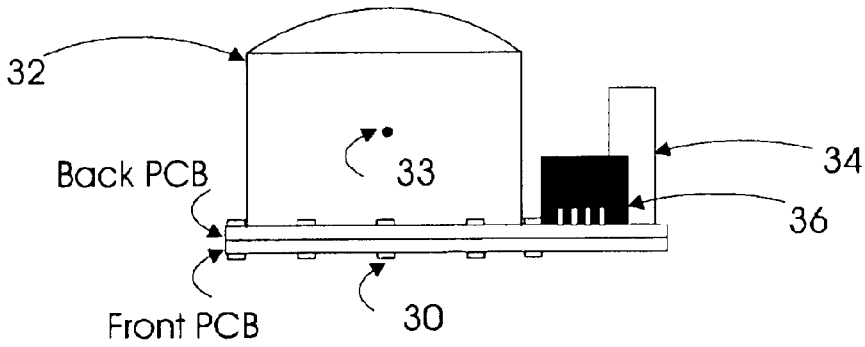
FIG. 8 is a schematic drawing of an ESL device having a sound box design.

In accordance with another aspect of the invention, FIG. 8 is a schematic drawing of an ESL device having a sound box design. The box itself, 32, has a 1-inch diameter and an approximately 0.75-inch deep space formed by a PVC end cap. A 0.035-inch diameter venting hole, 33, is drilled into the side of the cap to permit pressure equilibration during operation. The cap is filled with approximately 0.5 grams of polyester fiberfill to dampen vibrations in the direction of the cap. This figure shows a mounting post, 34, affixed through the mounting hole, 27 (not shown in FIG. 8), mounting nuts and bolts, 30, attaching the front and back PCBs together through assembly holes, 21 (not shown in FIG. 8), and an assembly, 36, of on-board electronics and electrical connectors from the signal amplifier.

Figure 9:
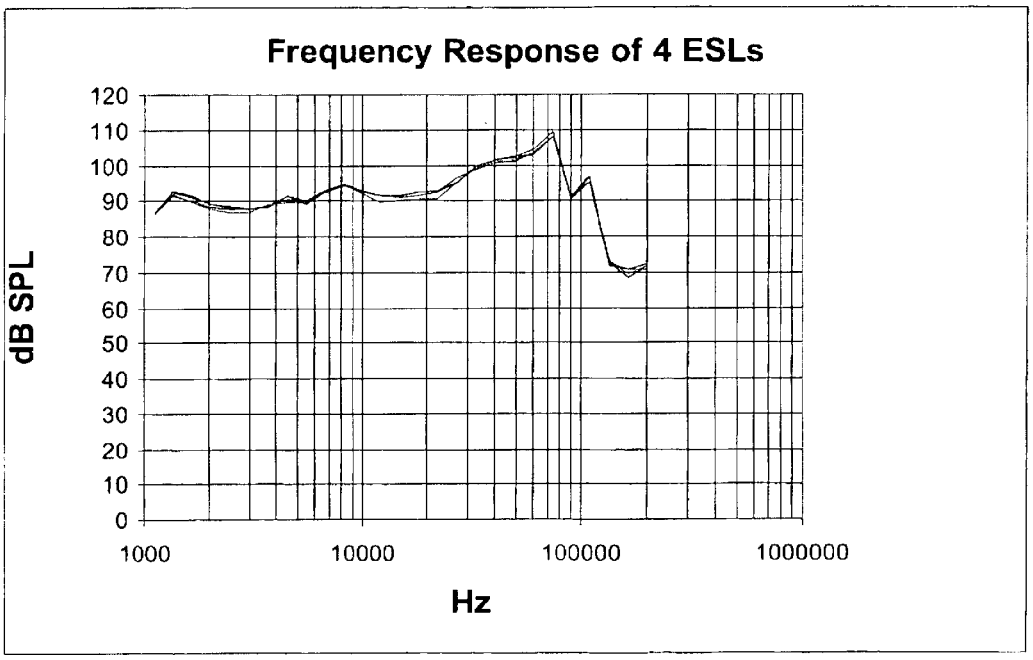
FIG. 9 is a figure of the response curve from four ultrasonic ESLs made according to this invention.

FIG. 9 is a figure of the response curve from four ultrasonic ESLs made in accordance with a preferred embodiment of the invention. The figure demonstrates these ESLs are capable of superior and consistent performance. The four speakers tested show consistent, relatively flat sonic output over a wide range of frequencies, in this example, extending from 1,000 Hz to 120,000 Hz.

Figure 10:
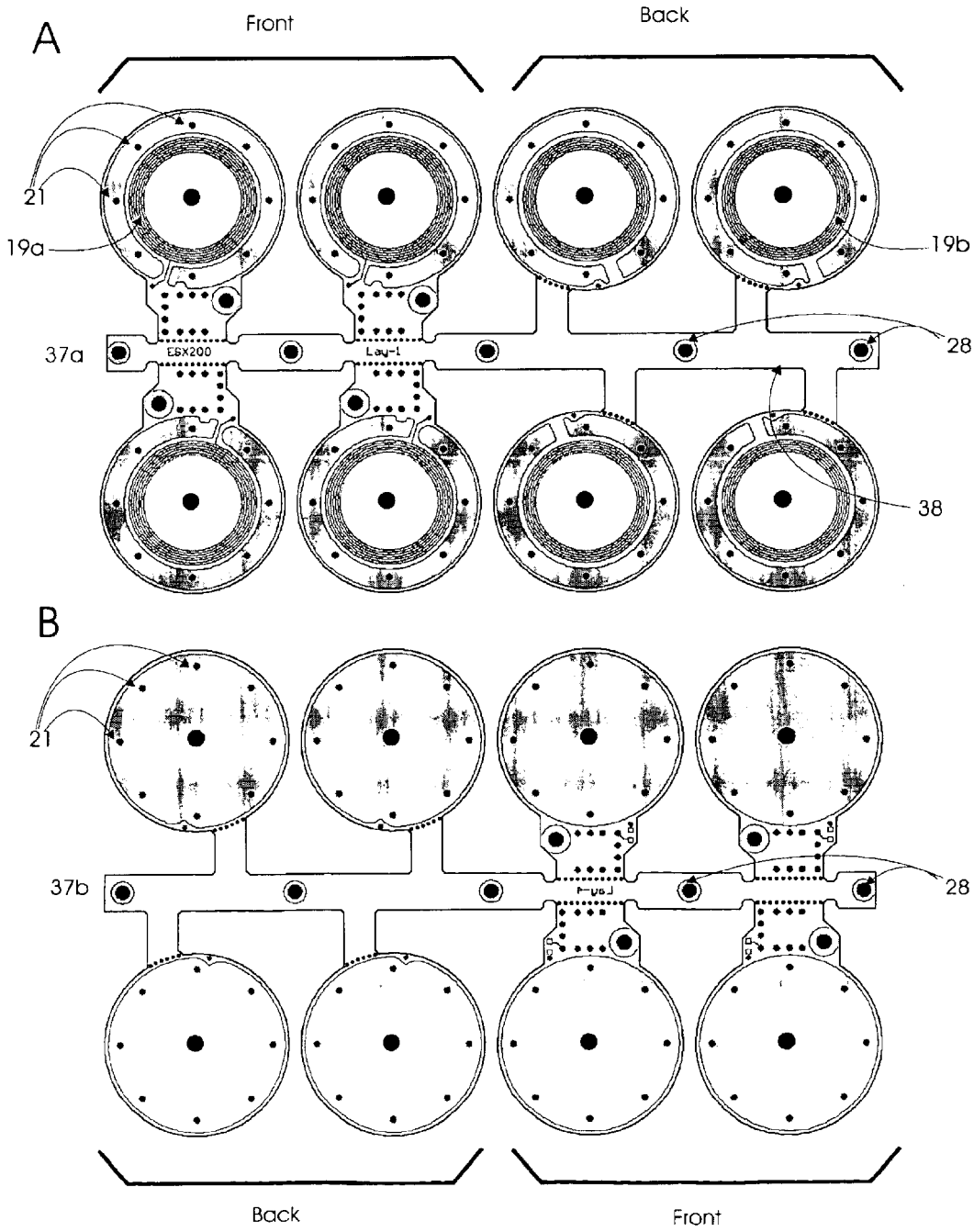
FIG. 10 shows two PCB panels, one with an inner layer view and the other with an outer layer view, each panel having four front sides and four rear sides. These figures show additional mounting holes for alignment during mass production of speakers.

FIG. 10 shows two PCB panels, panel 37*a* and 37*b*, each having four front sides and four rear sides.

Referring to FIG. 10, for a preferred embodiment of the method of manufacture of a 1.5-inch diameter ESL according to this invention, a first PCB panel 37*a*, is placed on a flat surface. This panel consists of eight speaker areas, four for the front and four for the rear sides, connected by a fiberglass frame 38 with alignment holes 28. A small amount of general-purpose adhesive is placed on or outside the parallel spaced ridges, 19*a*, of the four front-side speaker areas of this first PCB panel, 37*a*.

Then a piece of polyester film membrane, such as sold under the brand name "MYLARt®", having been metallized on one side, is placed over the four front-side speaker areas of the first PCB panel 37*a* and is stretched tautly by hand, maintaining its taut position by adhering to the adhesive. Next, a second PCB panel 37*b*, also having four front and four rear speaker areas, is prepared as above, by applying adhesive to the four front speaker areas and stretching the membrane tautly across these speaker areas.

The next step is cutting away the excess membrane beyond the outer ridges that comprise the SMHM. This has been achieved by cutting with a soldering iron set to an appropriate temperature, approximately 750 degrees Fahrenheit. The cutting can be done by heat, pressure, a combination of heat and pressure, and by other means known to those skilled in the art.

Then, the second PCB panel, 37*b* is placed over the first PCB panel, the alignment aided by alignment holes, 28, such that the surrounding parallel spaced ridges 19*b* of each rear side speaker area of PCB panels 37*a* and 37*b* press the membrane between the parallel spaced ridges 19*a* of each front side speaker area of PCB panels 37*a* and 37*b*. Then the two PCB panels are attached by nuts and bolts passing through holes 21.

After so affixing each speaker panel together, the speaker areas are separated from the fiberglass frame 38 and each ESL is placed in a drying oven to further tighten the membrane in place. The heating process is done in three consecutive stages, each about 45 seconds duration: first stage is 120 degrees Celsius; second stage is 260 degrees Celsius, and third stage is 25 degrees Celsius.

A ratio of the ridge spacing to polyester film thickness of about 100:1 has been found to be effective in production of ESLs according to this invention. For ESLs that are approximately 1.5 inches in total diameter, a 0.1-mil thickness polyester film is used, and the ridge-to-ridge spacing is approximately 10 mils. For a larger speaker, approximately 3.0 inches in total diameter, a 0.4 mil thickness polyester film is used, and the ridge-to-ridge spacing is approximately 40 mils.

The membrane, 15, can be composed of any suitable thin flexible material that can hold a biasing charge. In embodiments so far developed, one side has been metallized for charging. Charging both sides is an alternative according to the invention. In current practice, polyester films 2.5 to 10.0 micrometers thick are used. The standard charge on the metallic layer on one side of the film is about 50 volts/mil of the membrane to stator distance. In ESLs produced according to this invention, the membrane to stator distance is about 12 mils, so the biasing charge is about 600 volts. The standard audio drive voltage going to the stators is about 100 volts/mil of membrane to stator distance. In ESLs produced according to this invention, with the membrane to stator distance being about 12 mils, the voltage to the stators is about 1,200 volts.

During operation of this ESL embodiment, electrical channeling in one PCB panel provides biasing electric current to the chargeable side of the polyester film membrane from an external source. Other electrical channeling in the PCBs conducts separate electrical signal to stators on the PCBs. This latter signal causes the membrane to vibrate when the electrical charges on the stators attract or repel the charge on the membrane. At least one aperture on the outermost layers of one or both PCB panels permits acoustical waves to leave the ESL. Also, in this embodiment, which has a large diameter stator, holes 21 through the stator are provided to pass sound from the membrane 15 to the outside aperture. In other embodiments, at least one aperture can be provided through a central speaker area through an area other than a stator.

This method of manufacture provides the advantages of obtaining proper membrane tensioning, and obtaining uniform spacing between the membrane and stators. In this preferred embodiment, membrane tensioning is achieved primarily when parallel spaced ridges from opposite PCBs intermesh, pulling the membrane taut across the hills and valleys of these ridges.

Another process of manufacture, used on a 3-inch diameter circular ESL, involves two structures on each side of the membrane. The innermost structure on each side is an IMHM, comprising an SMHM, having four ridges on one IMHM and five ridges on the opposing IMHM. The membrane is applied onto one side's SMHM, to which adhesive was applied. Additional tensioning results from intermeshing with the ridges of the opposing SMHM during affixing, and heating after affixing is complete. The IMHM having the five ridges has an electrical circuit to the outmost ridge. The outmost structures on each side are PCBs comprising three layers each. The inner layer has a perimeter band, used here for spacing purposes, and a stator through which a multitude of apertures are drilled. The middle layer is insulating fiberglass, and the outer layer comprises a retaining shield covering most of the outside surface. Holes dispersed near the edge of the structures are used to affix the ESL with nuts and bolts, and a structure to one side of one PCB provides a junction for electrical leads to the electrical circuitry herein described. Trans-layer connections complete the electrical necessary electrical circuitry.

Using combinations of selected materials, the fabrication method can be scaled up and automated, to provide high-quality, relatively inexpensive speaker devices of arbitrary shape and dimensions. The method of manufacture disclosed herein provides a means to mass produce the electrostatic speakers of this invention by forming a sandwich of two or more substantially rigid structures having a thin flexible film, such as metallized polyester film, situated between the structures.

In accordance with another aspect of the invention, the following describes one method of mass manufacture of electrostatic speakers. The use of a PCB on at least one side makes mass manufacture a simple, effective process. The steps of the method that follows shows two PCBs, one for each side, although it will be appreciated that the same method can be followed using one PCB and one OMHM, or other combinations previously described:

1. Polyester film on a roll is stretched above a PCB speaker panel, containing at least one speaker area, wherein the panel has been mounted in a fixture using the alignment holes on the panel's spine.
2. To hold the polyester film down on each speaker area, an automatic roller applies glue to areas of the ridges on the surrounding membrane holder.
3. The polyester film is pressed against the speaker panel and heated from above using a flat metal iron-like heater to adhere the polyester film to the glue on the ridges.
4. The polyester film is stamped with a heated metal stamp to cut the polyester film at or beyond the edge of the ridges of the surrounding membrane holder.
5. The PCB board is separated from the polyester roll, leaving polyester membranes on each speaker area of the speaker panel, extending across the central speaker area and over the surrounding membrane holder.
6. A second PCB speaker panel, containing at least one speaker area that conform in position to the first speaker panel, is lowered onto the first speaker panel, sandwiching the polyester membrane between the two PCB speaker panels. The PCB speaker panels will be aligned with alignment holes on the spine of the panels.
7. Each PCB speaker area is secured together with screws or other attachment means.
8. Each PCB speaker area is separated from the PCB speaker panel to provide a single PCB speaker unit.
9. Electrical connections and related components, such as amplifiers, are mounted to each PCB speaker unit.

In a preferred embodiment, the PCB boards will be manufactured with a desired configuration of at least one hole for sound transmission. In other embodiments, where a PCB with at least one stator is on one side of the membrane, other structures, such as an OMHM, or an OMHM and an IMHM together, can be on the opposite side of the membrane.

It is also noted that an ESL made in accordance with this invention can have one PCB on one side of the membrane, with the membrane attached securely during manufacture, for example with an effective adhesive over a broad SMHM, such that an opposing structure is not required.

In another aspect of this invention, an ESL has a single aperture on one side which is fitted with a hollow tube that passes acoustical signals from the ESL directly to an animal's ear. This has been utilized for acoustical research with laboratory animals. In one embodiment, an adaptor tip was glued onto the exterior surface surrounding the aperture, and a 1 mm diameter hollow tube was attached to the adaptor. The other end of the tube was inserted gently into the animal's ear, and acoustical signals passed from the speaker to the ear via the tube.

In use, the electrostatic speaker of the present invention is useful in any situation where a broad range of frequencies is required to be produced with a high level of fidelity at a low cost. In addition, because the electrostatic speaker of this invention does not require the use of electromagnetic inductance, the speaker of this invention is useful in any situation where sound is required and where electromagnetic flux would be problematic. One such situation is where a patient is required to undergo magnetic resonance imaging (MRI), or an analogous procedure. In such a situation, the patient is required to remain motionless, sometimes for extended periods of time. The ability for the patient to listen to music or other pleasant sounds is facilitated by this invention, whereas standard electromagnetically based speakers would interfere with accurate MRI readings.

Having generally described this invention, including the best mode thereof, those skilled in the art will appreciate that the present invention contemplates the following embodiments, and equivalents thereof. However, those skilled in the art will appreciate that the scope of this invention should be measured by the claims appended hereto, and not merely by the specific embodiments exemplified herein.

What is claimed is:

1. A process of manufacture of electrostatic speakers comprising the steps of:

a Preparing a first printed circuit board comprising at least one stator, at least one electrical circuit, and a surrounding membrane holding means;

b Preparing an opposing membrane holding means, said opposing membrane holding means comprising a surrounding membrane holding means; and c Affixing a membrane between said printed circuit board and said opposing membrane holding means;

wherein said at least one electrical circuit situated on the printed circuit board connects to said at least one stator, and at least one electrical circuit situated either on said printed circuit board or on said opposing membrane holding means connects to the membrane, and wherein, in affixing the membrane between said printed circuit board and said opposing membrane holding means, a central speaker area is situated internal to an area defined by the surrounding membrane holding means, said central speaker area having a space sufficient to permit said membrane to vibrate without contacting any part of, or transferring a charge from the membrane to, the printed circuit board or the opposing membrane holding means, said sufficient space provided either by: (i) preparing the surrounding membrane holding means on one or both sides of the membrane with sufficient height; (ii) preparing the printed circuit board and preparing the opposing membrane holding means, such that each part's central speaker area has sufficient space; (iii) providing an additional means for spacing between the membrane and the printed circuit board and the opposing membrane holding means; or, providing the sufficient space by a combination selected from (i), (ii) and (iii).

2. The process of manufacture of electrostatic speakers according to claim 1 herein wherein said printed circuit board, said opposing membrane holding means, or both, are provided with at least one aperture to facilitate the passage of acoustical signals beyond said electrostatic speaker.

3. The process of manufacture of electrostatic speakers according to claim 2 wherein the surrounding membrane holding means of the printed circuit board is prepared with at least one continuous ridge surrounding the central speaker area, and the opposing membrane holding means is prepared with at least two parallel continuous ridges, wherein, during affixing the membrane, the membrane is positioned and tensioned by the parallel ridges of the surrounding membrane holding means and the opposing membrane holding means press the membrane into valleys between the ridges of the opposing structure as the printed circuit board and the opposing membrane holding means are affixed together.

4. The process of manufacture of electrostatic speakers according to claim 3 wherein the opposing membrane structure comprises a printed circuit board.

5. The process of manufacture of electrostatic speakers according to claim 4 wherein said first printed circuit board, said printed circuit board that comprises said opposing membrane holding means, or both of said printed circuit boards, additionally comprise a metallic shielding means covering a sufficient portion of the exterior layer of said one or both printed circuit boards to reduce transmission of electromagnetic radiation beyond said electrostatic speaker.

6. The process of manufacture of electrostatic speakers according to claim 4 wherein the opposing membrane structure comprises a printed circuit board, said printed circuit board additionally comprising at least one stator and electrical circuitry connecting to said at least one stator.

7. The process of manufacture of electrostatic speakers according to claim 4 wherein the first printed circuit board, the opposing membrane holding means, or both, are prepared with electrical connections for the connection of at least one external source of electrical impulses to said electrical circuitry.

8. The method of manufacture of electrostatic speakers according to claim 5 comprising the additional steps of: attaching a blind cavity distal to one PCB to form a sound box.

9. The process of claim 1, wherein at least one electrical circuit, situated on said opposing membrane holding means, connects to the membrane.

10. A process of manufacture of electrostatic speakers comprising interposing and affixing a chargeable membrane between a first side and an opposing side, wherein i) said first side is selected from the group consisting of;
   (1) a PCB comprising at least one stator, electrical circuitry to the at least one stator, and a raised structure integral with the PCB that surrounds a central speaker area such that said raised structure contacts the membrane; and,
   (2) a PCB comprising at least one stator and electrical circuitry to the at least one stator, and a separate raised structure that surrounds a central speaker area such that said separate raised structure contacts the membrane; and, ii) said opposing side is selected from the group consisting of:
   (1) a PCB comprising at least one stator, electrical circuitry to the at least one stator, and a raised structure integral with the PCB that surrounds a central speaker area such that said raised structure contacts the membrane;
   (2) a PCB comprising at least one stator and electrical circuitry to the at least one stator, and a separate raised spacing structure that surrounds a central speaker area such that said spacing structure contacts the membrane;
   (3) a fastening structure disposed peripherally to a central speaker area, whereby said fastening structure contacts the membrane over or lateral to said raised structures of said first side;
   (4) an opposing structure that spans the central speaker area, comprising a raised structure positioned to meet the first side's raised structure, whereby said opposing side raised structure contacts the membrane, and,
   (5) an opposing structure that spans the central speaker area, and a separate raised structure positioned to meet the first side's raised structure, whereby said opposing side raised structure contacts the membrane; and (iii) a means for conducting a charge to said membrane is provided, and comprising the additional step of separating an excess membrane situated distal to said raised or separate structures contacting said membrane.

11. The process of manufacture of electrostatic speakers according to claim 10 comprising the additional step of heating the first side, the opposing side, and the membrane for a sufficient time to make the membrane taut.

12. The process of manufacture of electrostatic speakers according to claim 11 wherein said first side and said opposing side, or both, are provided with at least one aperture to facilitate a passage of acoustical signals beyond said electrostatic speaker.

13. The process of manufacture of electrostatic speakers according to claim 12 wherein said raised or separate structures contacting said membrane on either side are prepared from a group consisting of;

a. a roughened contracting surface having a high friction coefficient;
b. a contacting surface designed to receive adhesive effectively over a relatively broad area; and
c. opposing sets of parallel ridges, one structure having at least one ridge, and the other structure having at least two ridges, where an opposing ridge interposes between two ridges on the other structure continuously around the central speaker area.

14. The process of manufacture of electrostatic speakers according to claim 13 wherein at least one plate, peripheral to and surrounding the raised structure contacting said membrane, supports compressive forces from fastening means that affix the membrane between said first side and said opposing side.

15. The method of manufacture of electrostatic speakers according to claim 13 wherein the method of affixing said membrane between said first side and said opposing side employs evenly spaced screws, nuts and bolts, clips with holes for clips on the opposing side, where the clips attach under tension to a distal end of such holes, or similar mechanical attachments between said first and second printed circuit boards.

16. The method of manufacture of electrostatic speakers according to claim 13 wherein one side, selected from the group consisting of the first side and the opposing side, has a single aperture, additionally comprising fitting onto said aperture a tube for transfer of acoustical signals directly to a listening subject.

17. The process of claim 10, wherein said interposing and affixing is with said opposing structure comprised of the opposing structure of 10(ii)(4), additionally comprising at least one stator and electrical circuitry to the at least one stator.

18. The process of claim 10, wherein said interposing and affixing is with said opposing structure comprised of the opposing structure of 10(ii)(5), additionally comprising at least one stator and electrical circuitry to the at least one stator.

19. The process of claim 10, said separating being selected from the group consisting of cutting, heating or pressing.

* * * * *